US009651301B2

(12) United States Patent
Dickerson et al.

(10) Patent No.: US 9,651,301 B2
(45) Date of Patent: May 16, 2017

(54) SYSTEM AND METHOD FOR LIQUEFYING AND STORING A FLUID

(75) Inventors: Brian Edward Dickerson, Canton, GA (US); Laurent Brouqueyre, Kennesaw, GA (US); Gregg Russell Hurst, Acworth, GA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 662 days.

(21) Appl. No.: 13/498,394

(22) PCT Filed: Aug. 17, 2010

(86) PCT No.: PCT/IB2010/053718

§ 371 (c)(1),
(2), (4) Date: Mar. 27, 2012

(87) PCT Pub. No.: WO2011/036581

PCT Pub. Date: Mar. 31, 2011

(65) Prior Publication Data

US 2012/0180520 A1 Jul. 19, 2012

Related U.S. Application Data

(60) Provisional application No. 61/246,206, filed on Sep. 28, 2009.

(51) Int. Cl.
*F25J 1/00* (2006.01)
*F25J 1/02* (2006.01)

(52) U.S. Cl.
CPC ..... *F25J 1/0248* (2013.01); *F25J 1/0017* (2013.01); *F25J 1/0251* (2013.01); *F25J 1/0262* (2013.01); *F25J 2205/40* (2013.01); *F25J 2205/60* (2013.01); *F25J 2245/90* (2013.01); *F25J 2290/44* (2013.01)

(58) Field of Classification Search
CPC ..... F25J 1/0017; F25J 1/0248; F25J 1/0251; F25J 3/04812; F25J 3/04818; F25J 3/04836; F25J 3/04834; F25J 2205/40; F25J 2205/60; F25J 2245/90
USPC ..... 62/606, 614, 615, 616
See application file for complete search history.

(56) References Cited

U.S. PATENT DOCUMENTS 2,113,680 A * 4/1938 DeBaufre ..... 62/645
3,282,059 A 11/1966 Maher
(Continued)

FOREIGN PATENT DOCUMENTS

CN 1261428 A 7/2000
CN 1894535 A 1/2007
(Continued)

OTHER PUBLICATIONS

Aksel'Rod L.S. et al., "Tubular Purifying Heat Exchangers for Oxygen Plants", Springer, Chemical and Petroleum Engineering, Jan. 1965, vol. 1, Issue 1, pp. 30-35.

*Primary Examiner* — Frantz Jules
*Assistant Examiner* — Brian King
(74) *Attorney, Agent, or Firm* — Michael W. Haas

(57) ABSTRACT

A fluid is liquefied from a gaseous state to a liquid state, and the liquefied fluid is stored. In one embodiment, the fluid is oxygen. Mechanisms are employed that enhance the durability, longevity, reliability, efficiency, of a system used to liquefy the fluid.

18 Claims, 4 Drawing Sheets

(56) References Cited

U.S. PATENT DOCUMENTS

| | | | | | |
|---|---|---|---|---|---|
| 3,780,534 | A * | 12/1973 | Lofredo | C07C 7/005 | 62/47.1 |
| 3,830,993 | A * | 8/1974 | Schulze-Berge | G04C 23/30 | 200/35 R |
| 4,617,037 | A | 10/1986 | Okada | | |
| 5,154,737 | A * | 10/1992 | Jenkins et al. | 95/11 | |
| 6,212,904 | B1 | 4/2001 | Arkharov | | |
| 6,351,968 | B1 | 3/2002 | Habicht | | |
| 6,427,483 | B1 | 8/2002 | Rashad | | |
| 7,165,422 | B2 * | 1/2007 | Little | F17C 7/02 | 128/201.21 |
| 2004/0045315 | A1 * | 3/2004 | Kamoshita | F25B 9/145 | 62/615 |
| 2006/0000223 | A1 | 1/2006 | Dickerson | | |
| 2006/0130519 | A1 * | 6/2006 | Little | F17C 7/02 | 62/612 |
| 2007/0193446 | A1 | 8/2007 | Nakamura | | |

FOREIGN PATENT DOCUMENTS

| | | | |
|---|---|---|---|
| JP | 5719001 | | 2/1982 |
| JP | S58196802 | A | 11/1983 |
| JP | H03117878 | A | 5/1991 |
| JP | H04217777 | A | 8/1992 |
| JP | H04326901 | A | 11/1992 |
| JP | 2003071239 | A2 | 3/2003 |
| JP | 2006258302 | A | 9/2006 |
| WO | WO9901706 | A1 | 1/1999 |
| WO | WO2005047761 | A1 | 5/2005 |
| WO | WO2006052818 | S2 | 5/2006 |

* cited by examiner

SYSTEM AND METHOD FOR LIQUEFYING AND STORING A FLUID

CROSS-REFERENCE TO RELATED APPLICATIONS

This patent application claims the priority benefit under 35 U.S.C. §371 of international patent application no. PCT/IB2010/053718, filed Aug. 17, 2010, which claims the priority benefit under 35 U.S.C. §119(e) of U.S. Provisional Application No. 61/246,206 filed on Sep. 28, 2009, the contents of which are herein incorporated by reference.

BACKGROUND OF THE INVENTION

1. Field of the Invention

The invention relates to the liquefaction of a fluid from a gaseous state to a liquid state, and storage of the fluid in the liquid state.

2. Description of the Related Art

Systems for liquefying and storing a fluid that is in a gaseous state at ambient temperature and pressure are known. However, such systems are susceptible to unreliability, inefficiency, and ineffectiveness caused by moisture that can collect in the liquefaction and/or storage assemblies of such systems. Further, conventional systems for liquefying and storing a fluid do not provide for an efficient mechanism for regulating pressure within a storage assembly configured to store liquefied fluid, as the liquefied fluid begins to boil off to the gaseous state during storage.

SUMMARY OF THE INVENTION

One aspect of the invention relates to a system configured to liquefy a fluid from a gaseous state to a liquid state. In one embodiment, the system comprises a conduit, a valve, a heat exchange assembly, an interface, and a controller. The conduit has an inlet and an outlet, and is configured to direct fluid from the inlet to the outlet. The valve is disposed at the outlet of the conduit, and is selectably controllable between a first mode and a second mode. In the first mode the valve exhausts the outlet of the conduit. In the second mode the valve places the outlet of the conduit in fluid communication with a storage reservoir configured to store the fluid. The heat exchange assembly is in thermal communication with the conduit, and is operative to remove heat from fluid within the conduit to transform the fluid within the conduit from a gaseous state to a liquid state. The interface is configured to receive control inputs related to control of the heat exchange assembly. The heat exchange assembly is controllable to operate in a first state in which the heat exchange assembly removes heat from fluid within the conduit to transform the fluid within the conduit from a gaseous state to a liquid state, and in a second state in which the heat exchange assembly removes substantially less heat from fluid within the conduit than is removed in the first state. The controller is configured to control the operation of the heat exchange assembly and the valve responsive to the control inputs received at the interface such that, in response to reception at the interface of a control input requesting a switch of operation of the heat exchange assembly from the second state to the first state, the controller operates the valve in the first mode for a period of time prior to switching operation of the heat exchange assembly from the second state to the first state such that a flow of fluid from the input of the conduit through the valve purges the conduit of moisture prior to switching operation of the heat exchange assembly from the second state to the first state.

Another aspect of the invention relates to a method of liquefying a fluid from a gaseous state to a liquid state. In one embodiment, the method comprises receiving fluid at an inlet of a conduit, the conduit being configured to direct the fluid from the inlet to an outlet; receiving a control input to switch operation of a heat exchange assembly that is in thermal communication with the conduit into a first state from a second state, wherein in the first state the heat exchange assembly removes heat from fluid within the conduit to transform the fluid within the conduit from a gaseous state to a liquid state, and in the second state the heat exchange assembly removes substantially less heat from fluid within the conduit than is removed in the first state; responsive to the received control input, exhausting fluid received at the inlet of the conduit from the outlet of the conduit for a period of time to purge the conduit of moisture, wherein the fluid is exhausted through a valve in fluid communication with the outlet of the conduit; and switching the operation of the heat exchange assembly from the second state to the first state after the period of time.

Yet another aspect of the invention relates to a system configured to liquefy a fluid from a gaseous state to a liquid state. In one embodiment, the system comprises means for receiving fluid at an inlet of a conduit, the conduit being configured to direct the fluid from the inlet to an outlet; means for receiving a control input to switch operation of a heat exchange assembly that is in thermal communication with the conduit into a first state from a second state, wherein in the first state the heat exchange assembly removes heat from fluid within the conduit to transform the fluid within the conduit from a gaseous state to a liquid state, and in the second state the heat exchange assembly removes substantially less heat from fluid within the conduit than is removed in the first state; means for exhausting, responsive to the received control input, fluid received at the inlet of the conduit from the outlet of the conduit for a period of time to purge the conduit of moisture; and means for switching the operation of the heat exchange assembly from the second state to the first state after the period of time.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not a limitation of the invention. In addition, it should be appreciated that structural features shown or described in any one embodiment herein can be used in other embodiments as well. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION OF EXEMPLARY EMBODIMENTS

Figure 1:
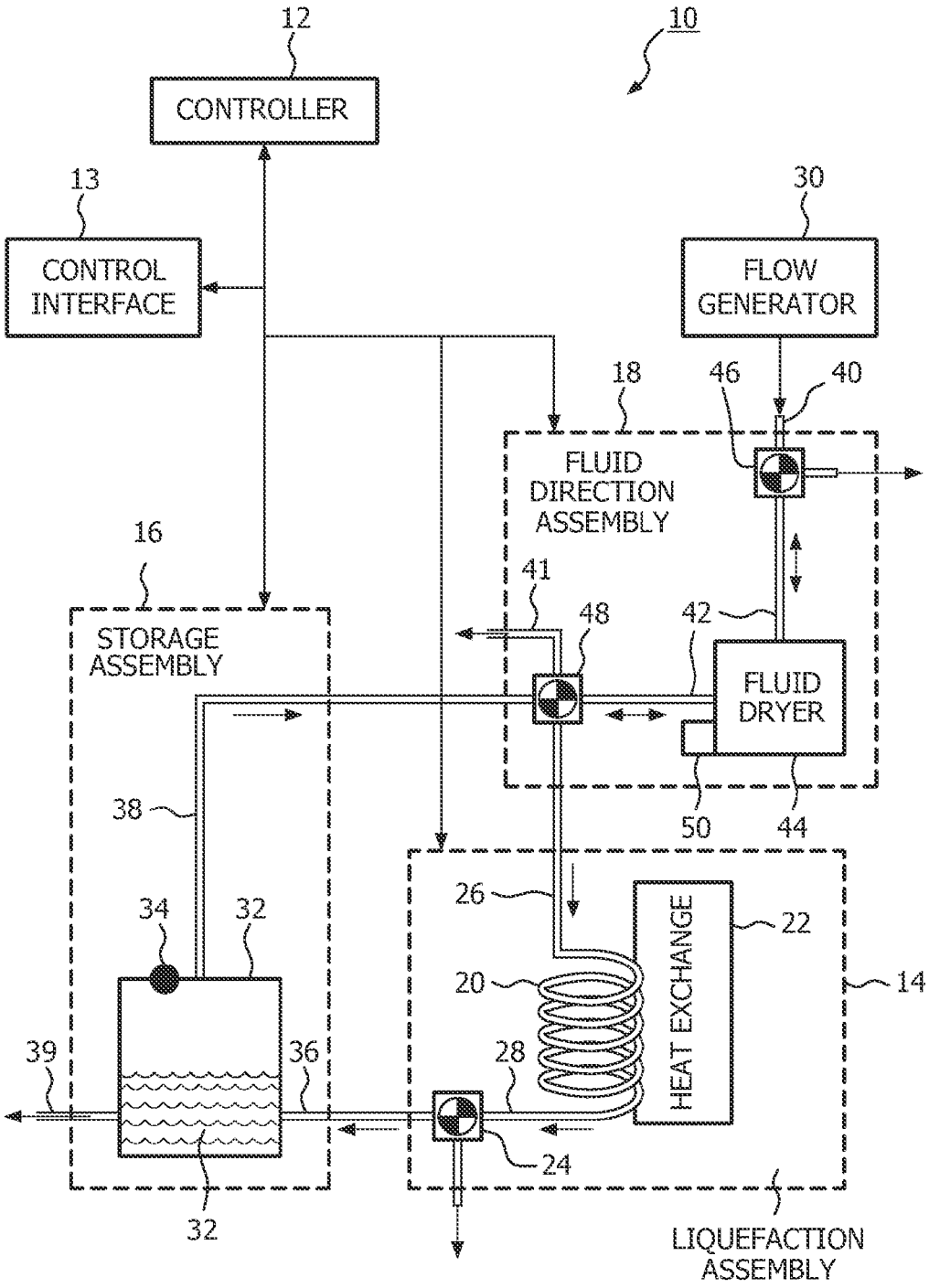
FIG. 1 illustrates a system configured to liquefy a fluid from a gaseous state to a liquid state, and to store the liquefied fluid, in accordance with one or more embodiments of the invention.

FIG. 1 schematically illustrates a system 10 configured to liquefy a fluid from a gaseous state to a liquid state, and to store the liquefied fluid. In one embodiment, the fluid is oxygen. However, this is not intended to be limiting, and the incorporation of one or more of the features of system 10 described herein in a system that liquefies and/or stores fluids other than oxygen fall within the scope of this disclosure. By way of non-limiting example, the fluid may be nitrogen, or other fluids. As is discussed below, system 10 includes features that enhance the durability, longevity, reliability, efficiency, of system 10 and/or individual components thereof. In one embodiment, system 10 includes a controller 12, a liquefaction assembly 14, a storage assembly 16, a fluid direction assembly 18, and/or other components.

Controller 12 is configured to provide information processing and control capabilities in system 10. As such, controller 12 may include one or more of a digital processor, an analog processor, a digital circuit designed to process information, an analog circuit designed to process information, a state machine, and/or other mechanisms for electronically processing information. Although controller 12 is shown in FIG. 1 as a single entity, this is for illustrative purposes only. In some implementations, controller 12 may include a plurality of processors. These processors may be physically located within the same device, or controller 12 may represent processing functionality of a plurality of devices operating in coordination. For example, in one embodiment, the functionality attributed below to controller 12 is divided between a first processor that is operatively connected to heat exchange assembly 14, a second processor that is operatively connected to storage assembly 16, and/or a third processor that is operatively connected to fluid direction assembly 18. Operative connections between controller 12 and the components of system 10 may be accomplished via a wired communication link, a wireless, communications link, a networked communications link, and/or a dedicated communications link. In one embodiment, one or more communications buses are included in system 10 that route output, communication, and control inputs between the components of system 10 and controller 12.

In one embodiment, controller 12 is associated with a control interface 13. The control interface 13 is configured to receive control inputs related to control of one or more components of system 10 by controller 12. For example, control interface 13 may include a user interface and/or a system interface. The user interface of control interface 13 is configured to provide an interface between system 10 and a user through which the user may provide information to and receive information from system 10. This enables data, results, and/or instructions and any other communicable items, collectively referred to as "information," to be communicated between the user and system 10. Examples of interface devices suitable for inclusion in the user interface of control interface 13 include a keypad, buttons, switches, a keyboard, knobs, levers, a display screen, a touch screen, speakers, a microphone, an indicator light, an audible alarm, and a printer. In one embodiment, the functionality of which is discussed further below, the user interface of control interface 13 actually includes a plurality of separate interfaces.

It is to be understood that other communication techniques, either hard-wired or wireless, are also contemplated by the present invention as the user interface of control interface 13. For example, the present invention contemplates that the user interface of control interface 13 may be integrated with a removable storage interface provided by electronic storage. In this example, information may be loaded into system 10 from removable storage (e.g., a smart card, a flash drive, a removable disk, etc.) that enables the user(s) to customize the implementation of system 10. Other exemplary input devices and techniques adapted for use with system 10 as the user interface of control interface 13 include, but are not limited to, an RS-232 port, RF link, an IR link, modem (telephone, cable or other). In short, any technique for communicating information with system 10 is contemplated by the present invention as the user interface of control interface 13.

system interface of control interface 13 is configured to receive calls for changes in the operation of components of system 10 (e.g. of individual components of liquefaction assembly 14, storage assembly 16, and/or fluid direction assembly 18) that come from within system 10. Such calls may even be generated by controller 12 itself. By way of non-limiting example, storage assembly 16, or controller 12 in performing control functionality associated with storage assembly 16, may issue a call for reduction or increase in the flow of liquefied fluid delivered to storage assembly 16 for storage. The system interface of control interface 13 is configured to receive calls for changes in the operation of components of system 10 that are issued by other systems operating in concert with system 10.

Liquefaction assembly 14 is configured to liquefy a flow of fluid from a gaseous state to a liquid state. The liquefaction assembly 14 liquefies the flow of fluid by removing heat from the fluid until the phase of the fluid transitions. Liquefaction assembly 14 cools the fluid to well below the phase transition. For example, in one embodiment in which the fluid is oxygen, liquefaction assembly 14 cools the oxygen to about −183° C. at 1 bar, and/or other temperatures. The liquefaction assembly 14 may include a conduit 20, a heat exchange assembly 22, a valve 24, and/or other components.

Conduit 20 has an inlet 26 and an outlet 28, and is configured to form a flow path that directs fluid from inlet 26 to outlet 28. The inlet 26 is disposed in system 10 to receive a flow of fluid in the gaseous state that has been provided to system 10 by a fluid gas flow generator 30. The fluid gas flow generator 30 may be included in system 10 as an integral part of system 10, or fluid gas flow generator 30 may be external to system 10 and may be coupled to system 10 to provide the flow of fluid to system 10. By way of non-limiting example, fluid gas flow generator 30 may include one or more of a pressure swing adsorption system, and/or other gas flow generators. In one embodiment, conduit 20 includes a length of tubing formed from a metallic material, such as copper, and/or other materials. In one embodiment, the flow path formed by conduit 20 has a coiled shape, or some other shape that enhances the path length of the flow path within a given area.

Heat exchange assembly 22 is disposed within system 10 in thermal communication with conduit 20. The heat exchange assembly 22 is configured to remove heat from fluid within conduit 20. For example, in one embodiment, heat exchange assembly 22 includes a compressor refrigeration system that cools a body in thermal communication (e.g., in direct contact) with conduit 20, or conduit 20 itself.

Controller 12 is in operative communication with heat exchange assembly 22, to control operation of heat exchange assembly 22. This includes controlling heat exchange assembly 22 to operate in at least a first state and a second state. In the first state, heat exchange assembly 22 removes heat from fluid within conduit 20 to transform the fluid from the gaseous state to the liquid state. In the second state, heat exchange assembly 22 removes substantially less heat from fluid within conduit 20. For example, in the embodiment in which heat exchange assembly 22 includes the aforementioned compressor refrigeration system, in the second state operation of a compressor included in heat exchange assembly 22 may be reduced or even halted.

Controller 12 controls heat exchange assembly 22 to operate in the first state during liquefaction of fluid flowing through conduit 20. For any of a variety of reasons, controller 12 may switch operation of heat exchange assembly 22 from the first state to the second state. For example, if system 10 is turned off or paused by a user (e.g., through input to controller 12), controller 12 may control heat exchange assembly 22 to operate in the second state. As another example, if the storage capacity of storage assembly 16 is reached, controller 12 may control heat exchange assembly 22 to operate in the second state to suspend the generation of liquid fluid for storage. As yet another example, if fluid gas flow generator 30 is not currently generating a flow of fluid in the gaseous state, controller 12 may control heat exchange assembly 22 to operate in the second state.

During operation of heat exchange assembly 22 in the first state while the fluid flowing through conduit 20 is being liquefied, moisture (e.g., water vapor and/or liquid) within the fluid is frozen out of the fluid to form a frost within conduit 20. During liquefaction of the fluid, this frost does not tend to stick to itself, or to the walls of conduit 20 in portions of conduit 20 in which the fluid is in the gaseous state (e.g., portions of conduit 20 relatively near inlet 26). However, in the latter sections of conduit 20 (sections of conduit 20 relatively near outlet 28), where the fluid has been transformed into the liquid state, the flow rate of the fluid through conduit 20 slows substantially. This drop in the flow rate may cause the frost to build up within conduit 20 in the latter sections of conduit 20 and cause clogging.

In one embodiment, the inner diameter of conduit 20 decreases from inlet 26 to outlet 28. This progressive decrease in the inner diameter of conduit 20 may cause the frost within the fluid to build-up and clog conduit 20. Further, in conventional liquefaction systems, if heat exchange assembly 22 is operated in the second state the temperature within conduit 20 increases. This may cause the frost within conduit 20 to soften (although in most implementations the temperature would not get high enough for outright melting). Upon returning heat exchange assembly 22 to the first state, the frost may be further softened and then migrated down conduit 20 toward outlet 28 by the initial flow of fluid through conduit 20. This softened frost may be more prone to sticking to the walls of conduit 20 and/or itself to form clogging. Clogs within conduit 20 are considered to be negative occurrences because they result in down time, require maintenance (e.g., to clean or replace conduit 20), cause collateral damage to other components of system 10 and/or fluid gas flow generator 30, and/or have other negative impacts.

Valve 24 is configured to selectively to either direct fluid from outlet 28 of conduit 20 to either storage assembly 16 or exhaust the fluid at outlet 28 out of system 10. In one embodiment, valve 24 is operable in a first mode and a second mode. In the first mode, valve 24 exhausts fluid from outlet 28 of conduit 20 from system 10. This may include exhausting the fluid to atmosphere and/or some waste receptacle. In the second mode, valve 24 directs fluid from outlet 28 of conduit 20 to storage assembly 16.

Valve 24 is controlled between the first mode and the second mode by controller 12. The controller 12 is configured to control valve 24 to reduce clogging within conduit 20. This includes operating valve 24 to purge conduit 20 of moisture when switching heat exchange assembly 22 between the second state and the first state. For example, in one embodiment, control interface 13 receives a control signals indicating that controller 12 should switch heat exchange assembly 22 from the second state to the first state to initiate (or re-initiate) the liquefaction of fluid within liquefaction assembly 14. In response to such control signals, controller 12 controls valve 24 to operate in the first mode while fluid in the gaseous state from fluid gas flow generator 30 (or some other gas source) flows through conduit 20. This may occur prior to actually switching heat exchange assembly 22 from the second state to the first state of operation. The flow of fluid in the gaseous state through conduit 20 prior to initiating liquefaction of the fluid within liquefaction assembly 14 purges conduit 20 of residual frost within conduit 20 from previous operation.

In one embodiment, controller 12 operates valve 24 in the first mode for a predetermined amount of time. The predetermined amount of time may be determined based on user input. In one embodiment, system 10 further includes one or more sensors at or near the exhaust of valve 24 that detect moisture content in the fluid being exhausted by valve 24. Controller 12 may operate valve 24 in the first mode until the moisture content in the fluid being exhausted by valve 24 falls below a predetermined threshold. The predetermined threshold may be determined based on user input.

Once the moisture within conduit 20 has been purged by the flow of fluid in the gaseous state, controller 12 controls valve 24 to operate in the second mode, and controls liquefaction assembly 14 to initiate liquefaction of the fluid within conduit 20. This may include switching heat exchange assembly 22 from the second state to the first state of operation.

Storage assembly 16 is in fluid communication with liquefaction assembly 14, and is configured to store fluid that has been liquefied by liquefaction assembly 14. In one embodiment, storage assembly 16 includes a storage reservoir 32, and one or more sensors 34. Some or all of storage assembly 16 may be formed in a Dewar container.

Storage reservoir 32 is configured to hold liquefied fluid received by storage assembly 16 from liquefaction assembly 14. The liquefied fluid is received into storage assembly 16 via an inlet 36 in fluid communication with valve 24 such that operation of valve 24 in the second mode directs fluid from liquefaction assembly 14 to inlet 36. Fluid in the gaseous state is released from storage reservoir 32 through an outlet 38 that is in fluid communication with fluid direction assembly 18. Fluid is released from storage reservoir 32 in the liquid state through a fluid liquid outlet 39.

Sensor 34 are configured to generate output signals conveying information related to the pressure within storage reservoir 32. In one embodiment, sensor 34 is disposed at or near outlet 38. The sensor 34 is in operative communication with controller 12 such that the output signals generated by sensor 34 are communicated to controller 12.

During storage of liquefied fluid within storage reservoir 32, the temperature of the fluid may begin to rise (e.g., due to the extremely large temperature difference between the liquefied fluid and ambient temperature). As the temperature rises, some of the fluid will begin to boil off from the liquid state to the gaseous state. The fluid boil off causes the pressure within storage reservoir 32 to rise, as the gaseous state of the fluid requires a greater volume than the liquid state. At some point, if this pressure increase is not relieved, storage reservoir 32 will leak and/or rupture.

In conventional systems, a valve is placed at or near outlet 38 that relieves the pressure within storage reservoir 32 caused by boil off. For example, the valve may be configured to open at a predetermined threshold level to exhaust some of the boiled off gas to atmosphere, thereby bringing the pressure within storage reservoir 32 back below the threshold level. For example, a high pressure outlet 41 may be configured to mechanically open, or "crack," if pressure rises above some predetermined threshold. This mechanism for regulating pressure within storage reservoir 32, however, is inefficient. The resources utilized in liquefying the fluid stored in storage reservoir 32 that eventually boils off and is exhausted have, in essence, been wasted. Further, exhausting some of the boiled off fluid does nothing to address the temperature creep of the remaining liquefied fluid.

System 10 is configured to regulate the pressure within storage reservoir 32 more efficiently than conventional systems. Rather than simply exhausting some of the fluid within storage reservoir 32, system 10 reduces the temperature within storage reservoir 32, thereby condensing some of the boiled off fluid back into liquid form to reduce the pressure within storage reservoir 32.

In one embodiment, controller 12 receives the output signal generated by sensor 34, and determines whether the pressure within storage reservoir 32 is too high (e.g., above a threshold). If the pressure is to high, a control signal is generated that causes controller 12 to control liquefaction assembly 14 to commence liquefaction of additional fluid to be introduced into storage reservoir 32. The temperature of the liquefied fluid received into storage reservoir 32 from liquefaction assembly 14 is far lower than the boil off temperature at which fluid within storage reservoir 32 is transforming from liquid to gas. As such, the introduction of additional liquefied fluid from liquefaction assembly 14 into storage reservoir 32 reduces the overall temperature within storage reservoir 32. Typically, the temperature of the fluid that has been recently boiled off is not much greater than the boil off temperature. Therefore, the reduction of the overall temperature within storage reservoir 32 caused by the introduction of additional fluid results in the condensation of at least some of the boiled off gas, which in turn reduces the pressure within storage reservoir 32.

If liquefaction assembly 14 is not currently liquefying fluid, commencement of liquefaction of additional fluid by liquefaction assembly 14 includes beginning to liquefy fluid. If liquefaction assembly 14 is currently liquefying fluid, commencement of liquefaction of additional fluid by liquefaction assembly 14 includes increasing the amount of fluid being liquefied. For example, if liquefaction assembly 14 is liquefying fluid at a given rate, the rate of liquefaction may be increased to commence liquefaction of additional fluid.

As will be appreciated, this operation of system 10 in response to an elevated temperature within storage reservoir 32 is seemingly the exact opposite of the response of conventional systems. Rather than releasing fluid from storage reservoir 32, system 10 adds more fluid, and relies on the relatively cold temperature of the additional fluid to reduce the pressure within storage reservoir 32 by causing condensation of boiled off fluid. This solution to regulating pressure within storage reservoir 32 is more efficient than the conventional solution because fluid that has been dried and liquefied for storage within storage reservoir 32 is not simply vented to atmosphere.

Fluid direction assembly 18 is configured to direct fluid between fluid gas flow generator 30 and system 10, between storage assembly 16 and atmosphere, and/or between system 10 and one or more other destinations. In one embodiment, fluid direction assembly 18 includes a fluid input 40, a conduit 42, a fluid dryer 44, a first valve 46, and a second valve 48.

Fluid input 40 is configured to receive the flow of fluid generated by fluid gas flow generator 30. In one embodiment, fluid input 40 enables fluid gas flow generator 30 to be removably coupled with system 10 so that the flow of fluid in the gaseous state that is generated by fluid gas flow generator 30 can be received into system 10 for processing and/or storage.

Conduit 42 is configured to convey the flow of fluid in the gaseous state received at fluid input 40 to liquefaction assembly 14 for liquefaction. The conduit 42 forms a flow path for the flow of fluid in the gaseous state between fluid input 40 and liquefaction assembly 14. In one embodiment, conduit 42 includes a one or more lengths of tubing formed from a metallic material, such as copper, non-metallic material, such as PVC or Tygon, and/or other materials. In one embodiment, conduit 42 includes a manifold that houses one or more of fluid dryer 44, first valve 46, and/or second valve 48.

Fluid dryer 44 is disposed in the flow path formed by conduit 42 such that the flow of gaseous fluid received at fluid input 40 is guided through fluid dryer 44 on the way to liquefaction assembly 14. The fluid dryer 44 is configured to remove moisture from flow of fluid in the gaseous state prior to the flow of fluid reaching liquefaction assembly 14. As has been discussed above, moisture in the flow of fluid can cause causing, with its associated drawbacks, in liquefaction assembly 14. Further, moisture in the flow of fluid may cause impurities in the liquefied fluid that is eventually stored to storage assembly 16. Thus, the function of fluid dryer 44 may be significant to the efficiency, effectiveness, reliability, and/or durability of system 10.

In one embodiment, fluid dryer 44 includes a cartridge or container that holds a desiccant. As the flow of fluid in the gaseous state passes through the cartridge, the desiccant removes the moisture from the flow of fluid. In one embodiment, another type of moisture extracting media is substituted for the desiccant.

First valve 46 is disposed in the flow path formed by conduit 42 between fluid dryer 44 and fluid input 40. First valve 46 is selectively operable in a first mode and in a second mode. Controller 12 is in operative communication with first valve 46, and controller 12 controls the operation of first valve 46 between the first mode and the second mode. In the first mode, first valve 46 directs the flow of fluid in the gaseous state that is received at fluid input 40 along conduit 42 toward liquefaction assembly 14. In the second mode, first valve 46 exhausts the flow of fluid in the gaseous state that is received at fluid input 40 from system 10. This may include exhausting the flow of fluid to atmosphere and/or a waste receptacle.

In one embodiment, controller 12 controls first valve 46 to mitigate the moisture that is introduced to system 10. This may extend the life of fluid dryer 44 (or the components thereof), and reduce the moisture that reaches liquefaction assembly 14 and/or storage assembly 16. In some instances, the moisture content in the flow of fluid generated by fluid gas flow generator 30 may fall from an initial level (present upon commencement of flow generation) to a lower equilibrium level when fluid gas flow generator 30 begins generating the flow of fluid. For example, fluid gas flow generator 30 may use an adsorption technology that, upon initiation, generates a flow of fluid that has an elevated level of moisture with respect to the typical level of moisture present during ongoing operation.

In one embodiment, to mitigate the moisture that is introduced into system 10 by the flow of fluid received at fluid input 40, when fluid gas flow generator 30 commences generation of the flow of fluid, controller 12 controls first valve 46 to operate in the second mode to exhaust the flow of fluid received at fluid input 40 out of system 10 until a moisture content of the flow of fluid is reduced. Once the moisture level of the flow of fluid received at fluid input 40 is reduced, controller 12 controls first valve 46 to operate in the first mode so that the flow of fluid received at fluid input 40 is delivered to liquefaction assembly 14 through conduit 42. To ensure that the moisture level of the flow of fluid is reduced, controller 12 may control first valve 46 to operate in the second mode for a predetermined period of time from the commencement of generation of the flow of fluid by fluid gas flow generator 30. The period of time may be based on user input. The period of time may be about 30 minutes, about 60 minutes, about 90 minutes, or for other durations of time. The controller 12 determines that fluid gas flow generator 30 has commenced generation of the flow of fluid based on communication with fluid gas flow generator 30 (e.g., via control interface 13).

As a non-limiting alternative, controller 12 may rely on direct measurement of the moisture in the flow of fluid to control first valve 46. The direct measurement of the moisture in the flow of fluid may be obtained by controller 12 from a sensor included in system 10 between fluid input 40 and first valve 46, and/or from fluid gas flow generator 30 itself (if fluid gas flow generator 30 includes a moisture sensor). Controller 12 may compare the measurement of moisture by the sensor and/or fluid gas flow generator 30 with a predetermined threshold. The predetermined threshold may be determined based on user input. The predetermined threshold may be about −60° C. dewpoint, and/or other levels of moisture.

Second valve 48 is located in the flow path formed by conduit 42 on the opposite side of fluid dryer 44 from first valve 46. Second valve 48 is operable in a first mode and a second mode. In the first mode, second valve 48 communicates the flow of fluid within the flow path formed by conduit 42 to conduit 20 of liquefaction assembly 14 for liquefaction. In the second mode, second valve 48 communicates the flow path of conduit 42 with outlet 38 of storage assembly 16. Controller 12 controls the operation of second valve 48 to dry fluid dryer 44, which extends the life of fluid dryer 44, enhances the effectiveness of first valve 46 and/or provides other benefits.

Generally, during operation, controller 12 controls second valve 48 to operate in the first mode to direct the flow of fluid within conduit 42 to liquefaction assembly 14 for liquefaction. However, periodically controller 12 controls second valve 48 to operate in the second mode for a short period of time. In conjunction with this switching of second valve 48, controller 12 also controls first valve 46 to operate in its second mode. This causes some of the fluid that is stored in storage assembly 16 and has boiled off into the gaseous state to be introduced into conduit 42, and to proceed through conduit 42 to be exhausted from system 10 through first valve 46. As will be appreciated from the foregoing, the fluid stored in storage assembly 16, after liquefaction by liquefaction assembly 14, is relatively dry. As it flows through fluid dryer 44, the dry fluid introduced to conduit 42 through second valve 48 will remove at least some of the moisture that has accumulated in fluid dryer 44, and exhaust the moisture from system 10 through first valve 46.

Controller 12 may be triggered to control first valve 46 and second valve 48 to dry fluid dryer 44 in the manner described above by one or more triggering events. In one embodiment, a triggering event is the pressure and/or amount of fluid within storage reservoir 32 of storage assembly 16 rising to a level that some of the fluid within storage reservoir 32 needs to be exhausted to atmosphere. In one embodiment, a triggering event is the passage of a period of time from a previous time that fluid dryer 44 was dried. In one embodiment, a triggering event is a determination (e.g., within controller 12) that some amount of fluid has been liquefied by liquefaction assembly 14. In one embodiment, a triggering event is the reception of a user command (e.g., via control interface 13).

The removal of moisture from fluid dryer 44 by a burst of fluid exhausted from storage assembly 16 may be enhanced by elevating the temperature of fluid dryer 44. To take advantage of this, in one embodiment, fluid direction assembly 18 includes a heater 50 configured to elevate the temperature of fluid dryer 44 during exhaustion of fluid from storage assembly 16 through fluid dryer 44. Heater 50 may elevate the temperature of fluid dryer 44 to above about 75° C., and/or to other temperatures above ambient temperature. In one embodiment, heater 50 includes a component of liquefaction assembly 14 that generates waste heat, or an element that is heated by waste heat generated by one or more components of liquefaction assembly 14. By way of non-limiting example, heater 50 may make use of waste heat generated by a refrigerant compressor associated with heat exchange assembly 22, in an embodiment in which heat exchange assembly 22 includes a compressor refrigerator.

It will be appreciated that the configuration of fluid direction assembly 18 is not intended to be limiting with respect to the mechanisms described for reducing moisture introduced to system 10 described above. Other configurations of valves and/or conduits in the infinite number of permutations of valve and/or conduit configurations that could be assembled to implement the mechanisms described above fall within the scope of this disclosure.

Figure 2:
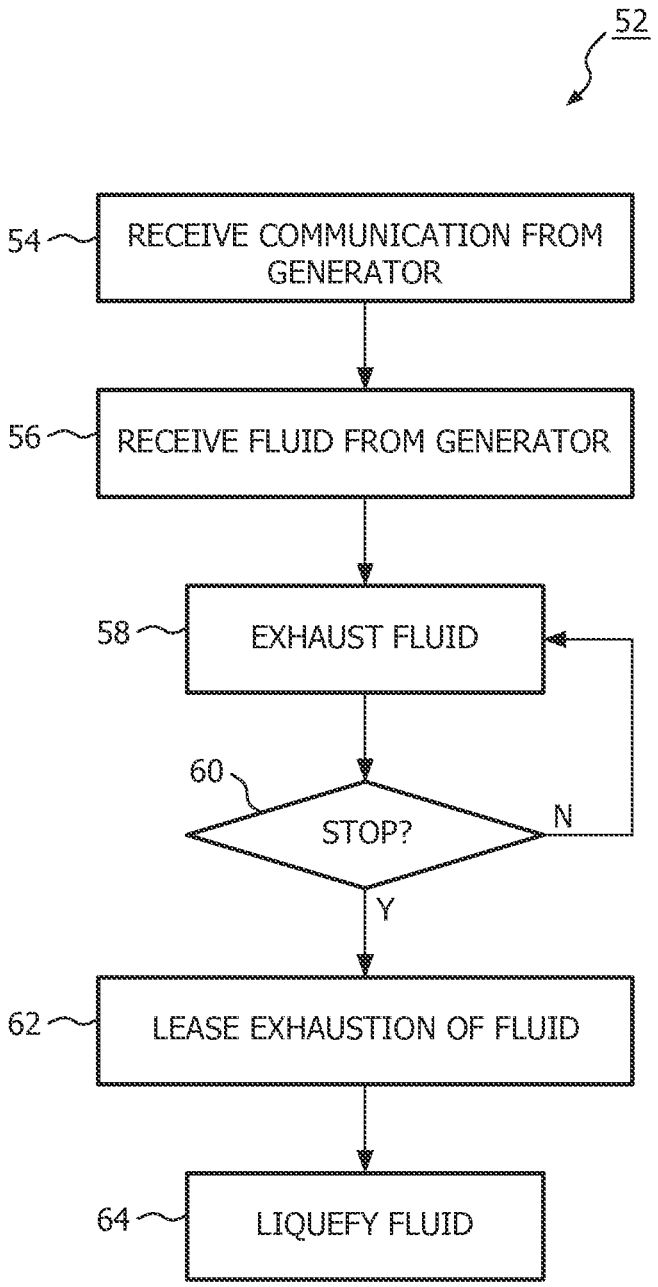
FIG. 2 illustrates a method of preparing a liquefaction assembly to begin liquefying a flow of fluid in a gaseous state into a liquid state, according to one or more embodiments of the invention.

FIG. 2 illustrates a method 52 of preparing a liquefaction assembly to begin liquefying a flow of fluid in a gaseous state into a liquid state. The operations of method 52 presented below are intended to be illustrative. In some embodiments, method 52 may be accomplished with one or more additional operations not described, and/or without one or more of the operations discussed. Additionally, the order in which the operations of method 52 are illustrated in FIG. 2 and described below is not intended to be limiting. In one embodiment, method 52 is performed by a system includes at least some of the features of system 10, shown in FIG. 1 and described above. However, in other embodiments, method 52 can be implemented in other contexts without departing from the scope of this disclosure.

At an operation 54, communication is received from a fluid gas flow generator that the fluid gas flow generator has commenced generation of a flow of fluid in the gaseous state for liquefaction. In one embodiment, operation 54 is performed by a controller that is the same as or similar to controller 12 (shown in FIG. 1 and described above).

At an operation 56, the flow of fluid in the gaseous state generated by the fluid gas flow generator is received. The flow of fluid may be received at a fluid input at a system configured to liquefy the flow of fluid. In one embodiment, operation 56 is performed by a fluid input of a fluid direction assembly that is the same as or similar to fluid input 40 of fluid direction assembly 18 (shown in FIG. 1 and described above).

At an operation 58, the flow of fluid received at the fluid input is exhausted (e.g., to atmosphere). In one embodiment, operation 58 is performed by a valve in fluid communication with the fluid input. For example, the valve may be the same as or similar to first valve 46 (shown in FIG. 1 and described above).

At an operation 60, a determination is made as to whether exhaustion of the flow of fluid from the fluid gas flow generator should be continued. In one embodiment, this determination includes determining whether a predetermined period of time has passed since the fluid gas flow generator commenced generation of the flow of fluid such that the moisture content in the flow of fluid has been reduced. In one embodiment, the determination at operation 60 includes detecting a moisture content in the flow of fluid received from the fluid gas flow generator, and basing the determination on the detector moisture content (e.g., comparing the moisture content with a threshold). Operation 60 may be performed by a controller that is in operative communication with one or both of the fluid gas flow generator and/or the valve exhausting the flow of fluid to atmosphere. For example, the controller may be similar to or the same as controller 12 (shown in FIG. 1 and described above).

If the determination is made at operation 60 that exhaustion of the flow of fluid should be continued, method 52 returns to operation 58. If the determination at operation 60 that exhaustion of the flow of fluid should not be continued, method 52 proceeds to an operation 62. At the operation 62, exhaustion of the flow of fluid is ceased, and the flow of fluid is delivered to a liquefaction module for liquefaction. In one embodiment, exhaustion of the flow of fluid to atmosphere is ceased by the valve, and the flow of fluid is delivered to the liquefaction module by a fluid direction assembly that is the same as or similar to fluid direction assembly 18 (shown in FIG. 1 and described above).

Figure 3:
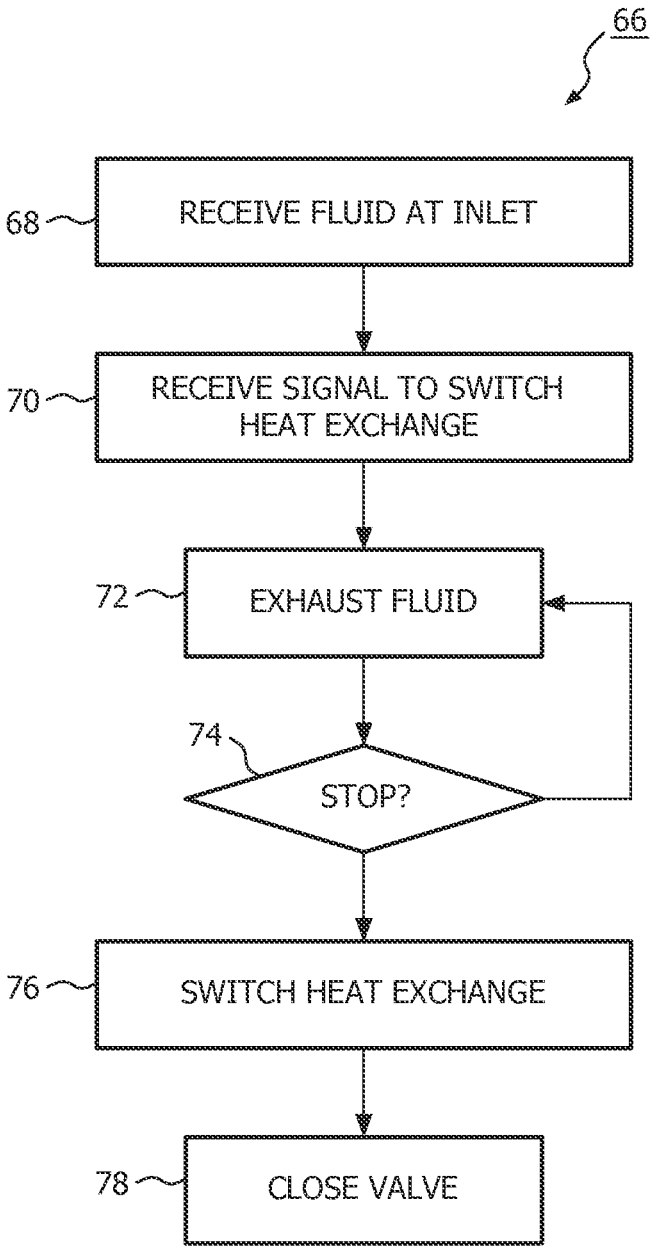
FIG. 3 illustrates a method of preparing a liquefaction assembly to begin liquefying a flow of fluid in a gaseous state into a liquid state, in accordance with one or more embodiments of the invention.

FIG. 3 illustrates a method 66 of preparing a liquefaction assembly to begin liquefying a flow of fluid in a gaseous state into a liquid state. The operations of method 66 presented below are intended to be illustrative. In some embodiments, method 66 may be accomplished with one or more additional operations not described, and/or without one or more of the operations discussed. Additionally, the order in which the operations of method 66 are illustrated in FIG. 3 and described below is not intended to be limiting. In one embodiment, method 66 is performed by a system includes at least some of the features of system 10, shown in FIG. 1 and described above. However, in other embodiments, method 66 can be implemented in other contexts without departing from the scope of this disclosure.

At an operation 68, a flow of fluid in the gaseous state is received at an inlet of a conduit associated with a liquefaction assembly configured to liquefy the fluid from the gaseous state to the liquid state. In one embodiment, operation 68 is performed by an inlet of a conduit that is the same as or similar to inlet 26 of conduit 20 (shown in FIG. 1 and described above).

At an operation 70, a control signal is received. The control signal indicates that a heat exchange assembly associated with the liquefaction assembly should be switched to a first state from the second state. In the first state, the heat exchange assembly removes heat from fluid within the conduit to transform the fluid from the gaseous state to the liquid state. In the second state, the heat exchange assembly removes substantially less heat from fluid within the conduit than is removed in the first state. In one embodiment, operation 70 is performed by a controller that is the same as or similar to controller 12 (shown in FIG. 1 and described above).

At an operation 72, responsive to receipt of the control signal at operation 70, fluid received at the inlet of the conduit is exhausted (e.g., to atmosphere) after passing through the conduit from the inlet to an outlet. In one embodiment, operation 72 is performed by a controller that controls a valve located downstream from the outlet of the conduit. The controller and/or the valve may be the same as or similar to controller 12 and/or valve 24 (shown in FIG. 1 and described above).

At an operation 74, a determination is made as to whether the flow of fluid should continue to be exhausted, or directed to a storage assembly for storage. In one embodiment, the determination made at operation 74 includes determining whether the flow of fluid has been exhausted for a period of time that will purge the conduit of residual moisture. The period of time may be a predetermined period of time. Operation 74 may be performed by a controller that is the same as or similar to controller 12 (shown in FIG. 1 and described above).

If the determination is made at operation 74 that the flow of fluid should continue to be exhausted, method 66 returns to operation 72. If the determination is made at operation 74 that the flow of fluid should no longer be exhausted, then method 66 proceeds to operation 76. At operation 76, the heat exchange is switched from the second state to the first state of operation to begin liquefying the flow of fluid through the conduit. In one embodiment, operation 76 is performed by a controller that is the same as or similar to controller 12 (shown in FIG. 1 and described above).

At an operation 78, the exhaustion of the flow of fluid after passing through the conduit is ceased, resulting in direction of the flow of fluid to a storage assembly for storage. In one embodiment, operation 78 is performed by a controller controlling the valve that was exhausting the flow of fluid. The controller and/or valve may be the same as or similar to controller 12 and/or valve 24 (shown in FIG. 1 and described above).

Figure 4:
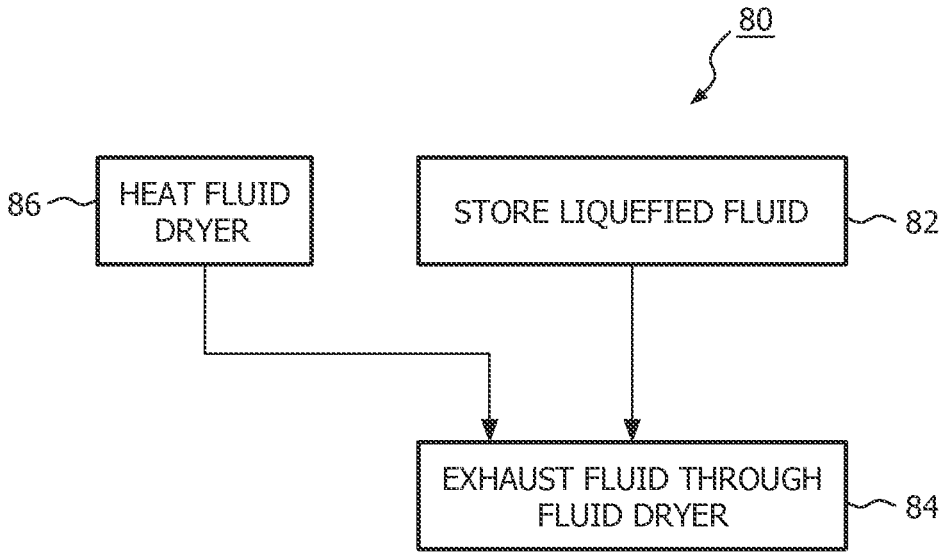
FIG. 4 illustrates a method of storing a liquefied fluid, according to one or more embodiments of the invention.

FIG. 4 illustrates a method 80 of storing a liquefied fluid. The operations of method 80 presented below are intended to be illustrative. In some embodiments, method 80 may be accomplished with one or more additional operations not described, and/or without one or more of the operations discussed. Additionally, the order in which the operations of method 80 are illustrated in FIG. 4 and described below is not intended to be limiting. In one embodiment, method 80 is performed by a system includes at least some of the features of system 10, shown in FIG. 1 and described above.

However, in other embodiments, method 80 can be implemented in other contexts without departing from the scope of this disclosure.

At an operation 82, fluid that has been liquefied by a liquefaction assembly is stored. In one embodiment, the liquefaction assembly is the same as or similar to liquefaction assembly 14 (shown in FIG. 1 and described above), and operation 82 is performed by a storage assembly that is the same as or similar to storage assembly 16 (shown in FIG. 1 and described above).

At an operation 84, fluid stored in the storage assembly and has boiled off to the gaseous state is exhausted through a fluid dryer configured to remove moisture from fluid in the gaseous state being introduced to the liquefaction module for liquefaction. Initiation of operation 84 may be based on the occurrence of one or more triggering events. In one embodiment, the fluid dryer is the same as or similar to fluid dryer 44 (shown in FIG. 1 and described above), and operation 84 is performed by a fluid direction assembly under control of a controller that are the same as or similar to fluid direction assembly 18 and controller 12 (shown in FIG. 1 and described above).

In one embodiment, at an operation 86, the fluid dryer is heated such that the temperature of the fluid dryer is elevated during operation 84. Operation 86 may be performed by a heater that is the same as or similar to heater 50 (shown in FIG. 1 and described above).

Figure 5:
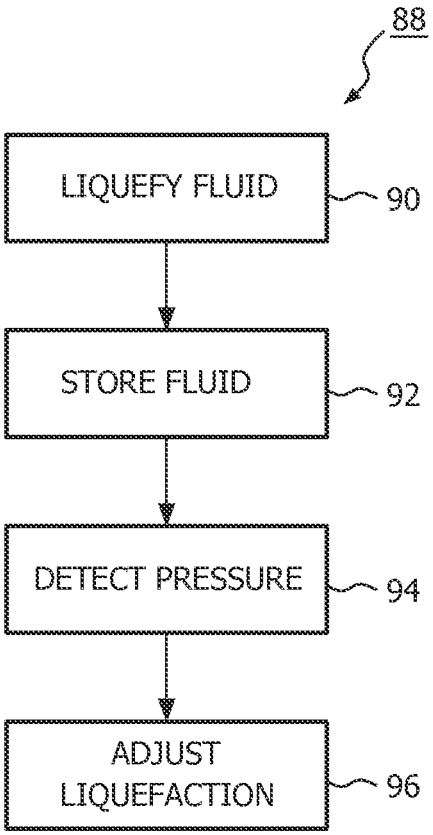
FIG. 5 illustrates a method of liquefying a fluid from a gaseous state to a liquid state, and of storing the liquefied fluid, in accordance with one or more embodiments of the invention.

FIG. 5 illustrates a method 88 of liquefying a fluid from a gaseous state to a liquid state, and of storing the liquefied fluid. The operations of method 88 presented below are intended to be illustrative. In some embodiments, method 88 may be accomplished with one or more additional operations not described, and/or without one or more of the operations discussed. Additionally, the order in which the operations of method 88 are illustrated in FIG. 5 and described below is not intended to be limiting. In one embodiment, method 88 is performed by a system includes at least some of the features of system 10, shown in FIG. 1 and described above. However, in other embodiments, method 88 can be implemented in other contexts without departing from the scope of this disclosure.

At an operation 90, a flow of fluid is liquefied from a gaseous state to a liquid state. In one embodiment, operation 90 is performed by a liquefaction assembly that is the same as or similar to liquefaction assembly 14 (shown in FIG. 1 and described above).

At an operation 92, the liquefied fluid is stored. In one embodiment, operation 92 is performed by a storage reservoir that is the same as or similar to storage reservoir 32 (shown in FIG. 1 and described above).

At an operation 94, pressure within the storage reservoir is detected. In one embodiment, operation 94 is performed by a sensor and controller that are the same as or similar to sensor 34 and controller 12 (shown in FIG. 1 and described above).

At an operation 96, responsive to the detected pressure, liquefaction of fluid for storage is adjusted. For example, if fluid within the storage reservoir boiling off causes the pressure within the storage reservoir to rise (e.g., above a predetermined threshold), then operation 96 includes commencing liquefaction of additional fluid to reduce the temperature within the storage reservoir. As another example, pressure within the storage reservoir is sufficiently low, the amount of fluid being liquefied for storage may be reduced. In one embodiment, operation 96 is performed by a liquefaction assembly that is the same as or similar to liquefaction assembly 14 (shown in FIG. 1 and described above) under control of a controller that is the same as or similar to controller 12 (shown in FIG. 1 and described above).

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A system configured to liquefy a fluid from a gaseous state to a liquid state, the system comprising:

a conduit having an inlet and an outlet, the conduit being configured to direct fluid from the inlet to the outlet;

a valve disposed at the outlet of the conduit, the valve being selectably controllable between a first mode and a second mode, wherein in the first mode the valve exhausts the outlet of the conduit and in the second mode the valve places the outlet of the conduit in fluid communication with a storage reservoir configured to store the fluid;

a heat exchange assembly in thermal communication with the conduit, the heat exchange assembly being operative to remove heat from fluid within the conduit to transform the fluid within the conduit from a gaseous state to a liquid state;

an interface configured to receive control inputs related to control of the heat exchange assembly, wherein the heat exchange assembly is controllable to operate in a first state in which the heat exchange assembly removes heat from fluid within the conduit to transform the fluid within the conduit from a gaseous state to a liquid state, and in a second state in which the heat exchange assembly removes substantially less heat from fluid within the conduit than is removed in the first state; and a controller configured to control the operation of the heat exchange assembly and the valve responsive to the control inputs received at the interface, wherein, in response to reception at the interface of a first control input requesting a first switch of operation of the heat exchange assembly from the first state to the second state, the controller operates the valve in the second mode while switching operation of the heat exchange assembly from the first state to the second state such that a flow of fluid from the outlet of the conduit remains in fluid communication with the storage reservoir, and wherein, in response to reception at the interface of a second control input requesting a second switch of operation of the heat exchange assembly from the second state to the first state, the controller operates the valve in the first mode for a period of time prior to switching operation of the heat exchange assembly from the second state to the first state such that the flow of fluid from the input of the conduit through the valve purges the conduit of moisture prior to switching operation of the heat exchange assembly from the second state to the first state.

2. The system of claim 1, wherein the controller is further configured to operate the valve in the second mode while the heat exchange assembly is being operated in the first state.

3. The system of claim 1, wherein the fluid is oxygen.

4. The system of claim 1, wherein the controller is configured to operate the valve in the first mode for a predetermined period of time prior to switching operation of the heat exchange assembly from the second state to the first state.

5. The system of claim 4, wherein the predetermined period of time is determined based on user input.

6. A method of liquefying a fluid from a gaseous state to a liquid state, the method comprising:

receiving fluid at an inlet of a conduit, the conduit being configured to direct the fluid from the inlet to an outlet;

receiving a first control input to switch operation of a heat exchange assembly that is in thermal communication with the conduit into a first state from a second state, wherein in the first state the heat exchange assembly removes heat from fluid within the conduit to transform the fluid within the conduit from a gaseous state to a liquid state, and in the second state the heat exchange assembly removes substantially less heat from fluid within the conduit than is removed in the first state;

responsive to the received first control input, exhausting fluid received at the inlet of the conduit from the outlet of the conduit for a period of time to purge the conduit of moisture, wherein the fluid is exhausted through a valve in fluid communication with the outlet of the conduit;

switching the operation of the heat exchange assembly from the second state to the first state after the period of time;

receiving a second control input to switch operation of the heat exchange assembly into the second state from the first state; and responsive to the received second control input, switching the operation of the heat exchange assembly from the first state to the second state while maintaining for another period of time the outlet of the conduit in fluid communication through the valve with a storage reservoir configured to store the fluid.

7. The method of claim 6, wherein the fluid is oxygen.

8. The method of claim 6, wherein the period of time is a predetermined period of time.

9. The method of claim 8, wherein the predetermined period of time is determined based on user input.

10. A system configured to liquefy a fluid from a gaseous state to a liquid state, the system comprising:

means for receiving fluid at an inlet of a conduit, the conduit being configured to direct the fluid from the inlet to an outlet;

means for receiving a first control input to switch operation of a heat exchange assembly that is in thermal communication with the conduit into a first state from a second state and for receiving a second control input to switch operation of the heat exchange assembly into the second state from the first state, wherein in the first state the heat exchange assembly removes heat from fluid within the conduit to transform the fluid within the conduit from a gaseous state to a liquid state, and in the second state the heat exchange assembly removes substantially less heat from fluid within the conduit than is removed in the first state;

means for exhausting, responsive to the received first control input, fluid received at the inlet of the conduit from the outlet of the conduit for a period of time to purge the conduit of moisture, wherein the fluid is exhausted through a valve in fluid communication with the outlet of the conduit; and means for switching the operation of the heat exchange assembly from the second state to the first state after the period of time and for switching the operation of the heat exchange assembly from the first state to the second state, responsive to the received second control input, while maintaining the outlet of the conduit in fluid communication through the valve with a storage reservoir configured to store the fluid.

11. The system of claim 10, wherein the fluid is oxygen.

12. The system of claim 10, wherein the period of time is a predetermined period of time.

13. The system of claim 12, wherein the predetermined period of time is determined based on user input.

14. The system of claim 1, wherein the fluid is nitrogen.

15. The method of claim 6, wherein the fluid is nitrogen.

16. The method of claim 6, further comprising closing the valve after the period of time to cease the flow of fluid from the outlet of the conduit.

17. The system of claim 10, further comprising means for ceasing the exhausting of fluid after the period of time.

18. The system of claim 10, wherein the fluid is nitrogen.

* * * * *